US006189454B1

(12) United States Patent
Hunt

(10) Patent No.: US 6,189,454 B1
(45) **Date of Patent: *Feb. 20, 2001**

(54) INERT PRACTICE ROUND WITH SOLID BODY

(76) Inventor: Gary D. Hunt, 22851 Ridge Rte. Dr., Lake Forest, CA (US) 92630

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/222,651

(22) Filed: Dec. 30, 1998

(51) Int. Cl.[7] ..... F42B 8/08
(52) U.S. Cl. ..... 102/444; 42/96
(58) Field of Search ..... 102/444, 446; 42/96

(56) References Cited

U.S. PATENT DOCUMENTS

| | | | | |
|---|---|---|---|---|
| 119,357 | * | 6/1871 | Hobbs | 102/444 |
| 2,342,549 | | 2/1944 | Gore et al. . | |
| 2,405,308 | * | 8/1946 | Jack | 434/19 |
| 2,882,821 | | 4/1959 | Benson . | |
| 3,016,832 | * | 1/1962 | Carlson | 102/444 |
| 3,444,639 | * | 5/1969 | Rockwood | 42/96 |
| 3,564,746 | * | 2/1971 | McConnell | 42/96 |
| 3,628,225 | | 12/1971 | Parker . | |
| 3,732,826 | | 5/1973 | Johnson . | |
| 3,749,021 | | 7/1973 | Burgess . | |
| 3,818,834 | | 6/1974 | Baumgartener . | |
| 3,848,350 | * | 11/1974 | Seminiano | 102/444 |
| 3,984,259 | | 10/1976 | Rogers, Jr. et al. . | |
| 4,100,693 | * | 7/1978 | Cech | 42/96 |
| 4,147,107 | | 4/1979 | Ringdal . | |
| 4,224,853 | * | 9/1980 | Bielman | 42/70.11 |
| 4,233,902 | | 11/1980 | Hartley et al. . | |
| 4,450,769 | | 5/1984 | Moser . | |
| 4,486,966 | * | 12/1984 | Seehase | 42/1.01 |
| 4,546,704 | | 10/1985 | Ballreich et al. . | |
| 5,027,710 | | 7/1991 | Wittman et al. . | |
| 5,179,234 | * | 1/1993 | Cvetanovich | 42/70.11 |
| 5,259,319 | | 11/1993 | Dravecky et al. . | |
| 5,291,832 | * | 3/1994 | Plummer | 102/444 |
| 5,315,778 | * | 5/1994 | Wolford | 42/70.11 |
| 5,396,844 | | 3/1995 | Hessey . | |
| 5,501,155 | | 3/1996 | Hollis et al. . | |
| 5,950,344 | * | 9/1999 | Ross | 42/70.11 |

FOREIGN PATENT DOCUMENTS

| | | | | |
|---|---|---|---|---|
| 1042267 | * | 11/1978 | (CA) | 102/446 |
| 596261 | * | 12/1947 | (GB) . | |

* cited by examiner

*Primary Examiner*—Peter M. Poon
*Assistant Examiner*—James S. Bergin
(74) *Attorney, Agent, or Firm*—Seyfarth Shaw

(57) ABSTRACT

An inert practice round has an elongated, solid body of aluminum having an external outline with the contour and size of a live round of a predetermined caliber. In one embodiment, the round comprises a unitary, one-piece, cavityless body. In another embodiment the body has an axial cavity formed centrally in the base end thereof and receives a cushioning structure, which may be all-plastic, plastic with a headed rivet embedded therein or a stack of O-rings or a coil spring with a rivet inserted therethrough.

12 Claims, 1 Drawing Sheet

INERT PRACTICE ROUND WITH SOLID BODY

BACKGROUND OF THE INVENTION

The present invention relates generally to reusable training or practice rounds of ammunition. The invention relates in particular to so-called "dummy" rounds of ammunition which contain no explosive.

In many practice or training applications of firearms, such as practice in use of the loading and ejection mechanisms, the use of live ammunition is not necessary. In such applications, the use of live ammunition is undesirable, because it is dangerous and expensive. It is dangerous because of the obvious risk of accidental discharge, which may create a life-threatening situation for the operator and endanger surrounding animate and inanimate objects. It is expensive because live ammunition is "consumed", even though not discharged or fired since, in undergoing contact with the loading and ejection mechanisms of firearms, live ammunition is generally damaged to the extent that it should not be relied on to fire properly. Thus, it is common to discard live ammunition after it has been used in testing or training in the loading and ejection mechanisms of firearms.

It is possible to use blank ammunition for testing, training or practice purposes, but this has most of the disadvantages of live ammunition, discussed above, although it is less dangerous because it does not have a projectile.

Accordingly, there have heretofore been provided inert or "dummy" practice rounds which do not contain explosives. However, some such prior inert practice rounds have been of relatively complex and expensive multi-part construction. Others, made for small caliber guns, have been made of plastic and can serve only as a dry fire round for a short period of time. Such practice rounds do not resemble live ammunition sufficiently for actual practice of loading and unloading of a firearm and will not cycle without breaking. Other types of practice rounds are simply made from real ammunition, assembled without primer or gun powder. These latter types cannot be dry fired and are also short-lived in cycling service due to being made of generally soft brass. Furthermore, prior inert practice rounds designed for larger caliber guns have typically been designed to closely simulate live ammunition of comparable caliber in appearance, weight and balance. Thus, such practice rounds could easily be mistaken for actual live ammunition.

SUMMARY OF THE INVENTION

It is a general object of the invention to provide an inert practice round which avoids the disadvantages of prior practice rounds while affording additional structural and operating advantages.

An important feature of the invention is the provision of an inert practice round which is of simple and economical construction that will withstand the rigors of extended cycling and dry firing.

Another feature of the invention is the provision of a practice round of the type set forth, which does not damage the firing pins of associated firearms.

Still another feature of the invention is the provision of a practice round of the type set forth which can readily be distinguished from live ammunition of the same caliber.

Certain ones of these and other features of the invention may be attained by providing an inert practice round comprising: a unitary, one-piece, solid, cavityless body having an external surface contour and size of a live round of a predetermined caliber.

Other features of the invention may be attained by providing a practice round wherein the body has an axial cavity formed centrally in the base end thereof and a cushioning structure disposed in the cavity.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figure 1:
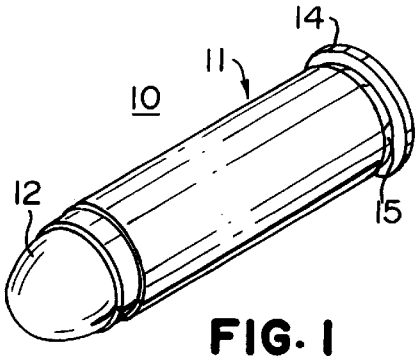
FIG. 1 is a front perspective view of a practice round in accordance with a first embodiment of the present invention.
Figure 2:
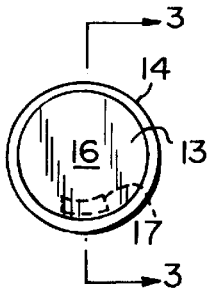
FIG. 2 is a rear elevational view of the practice round of FIG. 1.
Figure 3:
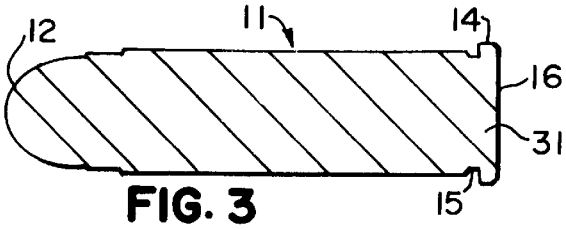
FIG. 3 is a view in vertical section taken along the line 3—3 in FIG. 2.

Referring to FIGS. 1–3, there is illustrated a practice round, generally designated by the numeral 10, constructed in accordance with a first embodiment of the invention. The practice round 10 has an elongated, cylindrical body 11 of unitary, one-piece, solid, cavityless construction, having a nose end 12 and a base end 13. The body 11 has an external surface with a contour and size substantially identical to that of a live round of ammunition of a predetermined caliber, in this case a .38 special. More specifically, the body 11 has a radially outwardly extending flange 14 at the base end 13 thereof and an annular groove 15 in the body 11 at the forward edge of the flange 14. The body 11 has a circular end face 16 at its base end 13, which may be provided with indicia 17 indicating the caliber of gun with which the practice round 11 is intended to be used, the peripheral edge of the face 16 being chamfered, as at 18. While the body 11 could be formed of any solid, rigid and relatively hard material, it is preferably formed of a suitable metal. More specifically, in the preferred embodiment, the body 11 is machined from a solid block of aluminum. Thus, the practice round 10 has no explosive and no projectile and cannot be fired or discharged.

Because the practice round 10 is substantially identical in size and shape to live ammunition it will function in the loading and ejection mechanisms of firearms in the same manner as live ammunition of the same caliber, so that it can be effectively used for practice or training in the use of such firearm mechanisms. The practice round 10 is safe, much less expensive than live ammunition and, since it is not intended to be fired, can be reused.

While the practice round 10 is designed to have a size and shape substantially identical to that of a live round for the particular firearm with which it is to be used, it is a significant aspect of the invention that the practice round 10 is otherwise designed to be readily distinguishable from a live round. Thus, being formed of a solid body of aluminum, the practice round 10 will typically have a significantly lighter weight than a comparable live round with a lead projectile. Also, the aluminum body 11 is preferably hard anodized to a red or any other distinctive color so as to be readily visually distinguished from the standard brass cartridge casing of a live round. Because of the light weight of the practice round 10, a user can readily distinguish it from a live round even in the dark. These distinguishing characteristics of the practice round 11 will minimize the chances of its being mistaken for live ammunition.

Figure 4:
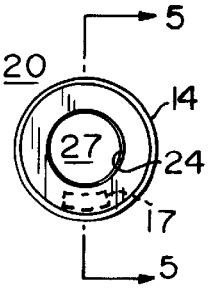
FIG. 4 is a rear elevational view of a practice round in accordance with a second embodiment of the invention.
Figure 5:
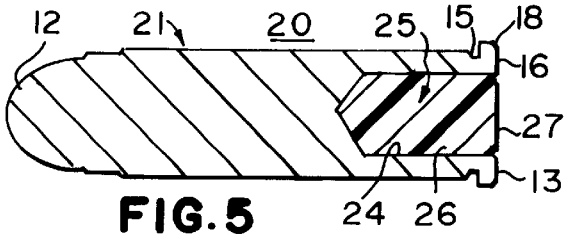
FIG. 5 is a view in vertical section taken along the line 5—5 in FIG. 4.

Referring to FIGS. 4 and 5, there is illustrated another embodiment of the invention, generally designated by the numeral 20, which is similar to the live round 10, so that like parts have the same reference numbers. The practice round 20 has a solid body 21 of unitary, one-piece construction which is the same general size and shape as the practice round 11 of FIGS. 1–3. However, in this case the body 21 has formed therein, centrally of the base end 13 thereof, an axial cavity 24, which extends forwardly approximately one-third of the length of the body 21. Disposed in the cavity 24 is a cushioning structure, generally designated by the numeral 25 which, in this embodiment, comprises a plug 26 of plastic material, preferably polyurethane. The plastic plug 26 fills the cavity 24 and may be secured therein by any suitable means. The plug 26 has a circular end face 27, which is substantially coplanar with the end face 16 of the body 21. While a plastic material is preferred for the plug 26, it could be formed of other materials, as long as the material is substantially softer and more resilient than the material of the body 21.

In use, the plug 26 is disposed so that it will be engaged by the firing pin of the associated firearm, thereby protecting the firing pin from damage or unnecessary wear.

Figure 6:
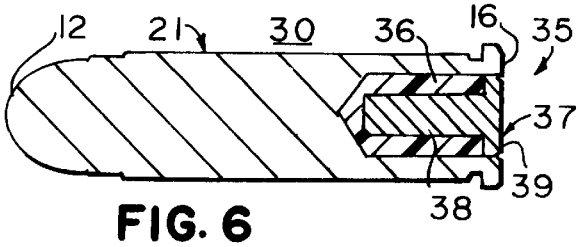
FIG. 6 is a view similar to FIG. 5 of another embodiment of the present invention.

Referring to FIG. 6, there is another practice round generally designated by the numeral 30 which, again, is similar to the practice round 20, so that like parts have the same reference numbers. In this case, the practice round 30 has a cushioning structure 35 disposed in the cavity 24. The cushioning structure 35 has a plug 36 of plastic material, in which is embedded a rivet 37, having an axial shank 38 and an enlarged circular head 39, the end face of which is substantially coplanar with the end face 16 of the body 21 and may be chamfered at its peripheral edge. The rivet 37 is preferably formed of brass and its head 39 is disposed for engagement with the firing pin of the associated firearm so as to have an effect thereon similar to that of the brass cartridge end of a live round, the impact of the firing pin with the rivet 37 being cushioned by the plastic plug 36.

Figure 7:
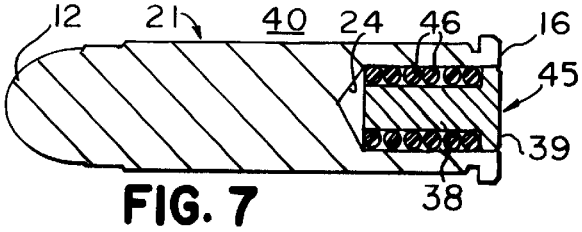
FIG. 7 is a view similar to FIG. 5 of another embodiment of the invention.

Referring to FIG. 7, there is disclosed another practice round 40, which is similar to the practice round 30, so that like parts have the same reference numbers. In this case, the cavity 24 is filled with a cushioning structure 45, which includes a plurality of O-rings 46 stacked coaxially in the cavity 24, the O-rings 46 preferably being formed of a flexible and resilient material, such as rubber or a suitable elastomer. The shank 38 of the rivet 37 is received through the openings in the O-rings 46. Preferably, the parts are so dimensioned that they may be press-fitted in place, although it will be appreciated that they could be retained in place by any other suitable means.

Figure 8:
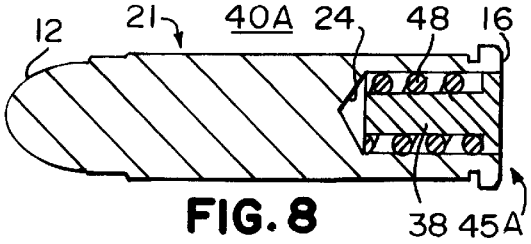
FIG. 8 is a view similar to FIG. 7 of another embodiment of the invention.

FIG. 8 illustrates a practice round 40A, which is substantially identical to that of FIG. 7, except that it includes a cushioning structure 45A which utilizes a helical compression spring 48 in place of the O-rings to provide the flexible and resilient cushioning.

Figure 9:
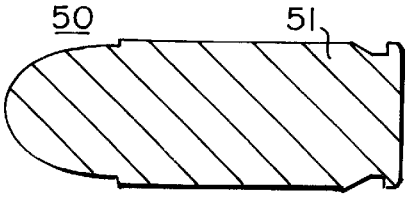
FIGS. 9 and 10 are views similar to FIG. 3 of practice rounds of other calibers.
Figure 10:
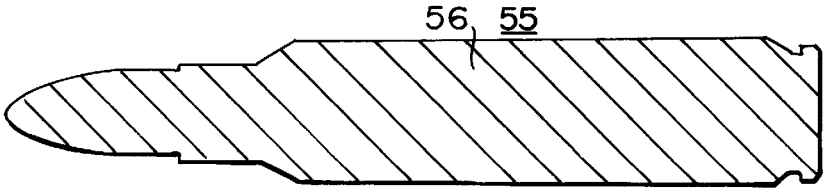

FIG. 9 illustrates a practice round 50 having a solid, cavityless body 51 of .45 ACP caliber, while FIG. 10 illustrates a practice round 55 with a solid, cavityless body 56 of .284 Winchester caliber. It will be appreciated that practice rounds of these calibers could also be made with cushioning structures like those of FIGS. 5–8.

While specific calibers of practice rounds have been shown, it will be appreciated that this is for purposes of illustration only, and that the principles of the present invention are applicable to any desired caliber. While the present invention is intended primarily for use with small arms, such has handguns, rifles and the like, they could also be used for practice rounds for larger caliber weapons. However, the fact that the practice rounds of the present invention do not match live rounds of comparable caliber in weight and balance may make them unsuitable for use in certain automatic weapons.

From the foregoing, it can be seen that there has been provided an improved inert practice round which is of simple and inexpensive construction, is readily distinguishable from live ammunition, and which can be safely and effectively used in lieu of live ammunition.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An inert practice round comprising:

an elongated, solid, rigid body having a nose end and a base end face with a base end face diameter and a longitudinal axis, said body having an external outline with the contour and size of a live round of a predetermined caliber, said body being cavityless except for an axial cavity formed centrally in the base end face thereof and having a cavity diameter at least one-half the base end face diameter and an axial extent substantially greater than the cavity diameter, and a cushioning structure disposed in said cavity and including a cushioning material substantially softer than that of said body.

2. The practice round of claim 1, wherein said body is formed of metal.

3. The practice round of claim 2, wherein said body is formed of aluminum.

4. The practice round of claim 3, wherein said body is anodized a distinguishing color.

5. The practice round of claim 1, wherein said body is formed of metal and said cushioning material is formed of plastic.

6. The practice round of claim 5, wherein said cushioning structure includes a rigid member.

7. The practice round of claim 6, wherein said body is formed of aluminum and said rigid member is formed of brass.

8. The practice round of claim 6, wherein said rigid member has a cylindrical shank and an enlarged-diameter head disposed at the base end of the body.

9. The practice round of claim 8, wherein said cushioning material is plastic and said shank is embedded in said plastic.

10. The practice round of claim 9, wherein said cushioning material includes a plurality of O-rings stacked coaxially in said cavity in encircling relationship with the shank of the rigid member.

11. The practice round of claim 9, wherein said cushioning material includes a helical compression spring disposed coaxially in said cavity in encircling relationship with the shank of the rigid member.

12. The practice round of claim 1, wherein the cushioning structure substantially fills the cavity.

* * * * *

UNITED STATES PATENT AND TRADEMARK OFFICE

CERTIFICATE OF CORRECTION

PATENT NO. : 6,189,454
DATED : February 20, 2001
INVENTOR(S) : Gary D. Hunt

It is certified that error appears in the above-identified patent and that said Letters Patent is hereby corrected as shown below:

(56) References Cited, U.S. Patent Documents, "4,224,853" should be --4,224,753--.

Signed and Sealed this

Fifth Day of June, 2001

Nicholas P. Godici

NICHOLAS P. GODICI

*Acting Director of the United States Patent and Trademark Office*

*Attest:*

*Attesting Officer*